US006964137B2

(12) United States Patent
Frascari

(10) Patent No.: US 6,964,137 B2
(45) Date of Patent: Nov. 15, 2005

(54) UNDERCUT ANCHORING ELEMENT FOR FIXING PLATES AND/OR TILES

(76) Inventor: Massimiliano Frascari, via San Martino, 11, Reggio Emilia I-42100 (IT)

( * ) Notice: Subject to any disclaimer, the term of this patent is extended or adjusted under 35 U.S.C. 154(b) by 0 days.

(21) Appl. No.: 10/451,164

(22) PCT Filed: Dec. 27, 2001

(86) PCT No.: PCT/IT01/00657

§ 371 (c)(1),
(2), (4) Date: Jun. 19, 2003

(87) PCT Pub. No.: WO02/053859

PCT Pub. Date: Jul. 11, 2002

(65) Prior Publication Data

US 2004/0060256 A1 Apr. 1, 2004

(30) Foreign Application Priority Data

Dec. 28, 2000 (IT) ..... RE 2000043 U

(51) Int. Cl.[7] ..... E04B 1/00

(52) U.S. Cl. ..... 52/235; 52/378; 52/379; 52/384; 52/385; 52/357; 52/509; 52/745.21; 52/390; 52/391; 52/506.01; 52/506.05; 52/510; 52/511; 52/513; 52/703; 52/704

(58) Field of Search ..... 52/235, 378–9, 52/384–389, 363, 357, 713, 509, 513, 749.1, 764, 745.21, 741.1, 506.01–5, 391, 390, 510, 511, 586.1, 698–701, 703–704, 706–711

(56) References Cited

U.S. PATENT DOCUMENTS

| | | | | |
|---|---|---|---|---|
| 1,976,595 | A | 10/1934 | Asleson et al. | 248/228.1 |
| 2,048,234 | A | 7/1936 | Tucker | 52/513 |
| 2,366,656 | A | 1/1945 | Saffert | 249/95 |
| 3,871,147 | A | 3/1975 | Stegmeier | 52/127.7 |
| 3,939,617 | A | 2/1976 | Eisses | 52/166 |
| 4,531,338 | A | 7/1985 | Donatt | 52/235 |
| 5,337,529 | A | 8/1994 | Lutin et al. | 52/389 |
| 5,417,050 | A | 5/1995 | Cosentino | 52/506.08 |
| 5,447,005 | A | 9/1995 | Giannuzzi | 52/698 |
| 5,819,486 | A | 10/1998 | Goodings | 52/235 |
| 6,098,364 | A | 8/2000 | Liu | 52/506.08 |
| 6,164,029 | A | 12/2000 | Lee | 52/386 |
| 6,170,214 | B1 | 1/2001 | Treister et al. | 52/511 |

*Primary Examiner*—Jeanette Chapman
(74) *Attorney, Agent, or Firm*—Thomas S. Baker, Jr.

(57) ABSTRACT

Elements of laminar bodies (1) made of metal or other material are disclosed, so shaped as to be inserted into straight undercut notches (3) made on plates and/or tiles (2). The laminar bodies (1) have such a sufficient length to protrude from straight undercut notches (3) and so shaped as to allow to be joined to each other or with another interposed body (9) through bolts (8) or the like or by means of joints, welding and the like, so as to form a single body (21) adapted to be anchored strongly to the plate and/or tile (2) allowing said plate to be safely and simply fixed to the structures supporting the facing (10).

9 Claims, 4 Drawing Sheets

FIG. 3A
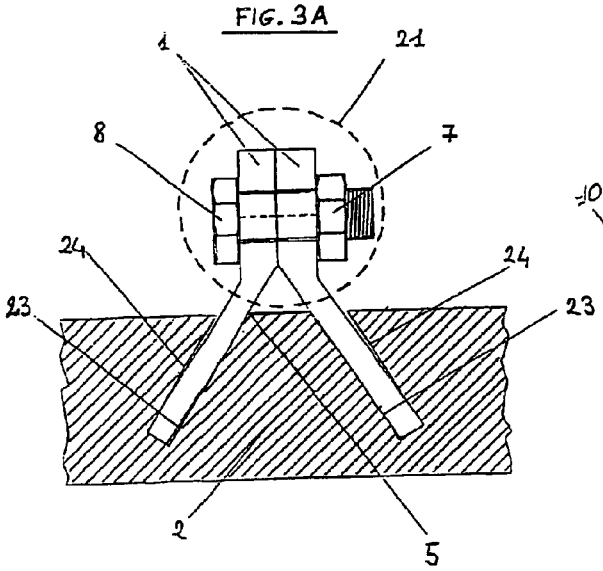
FIG. 3B
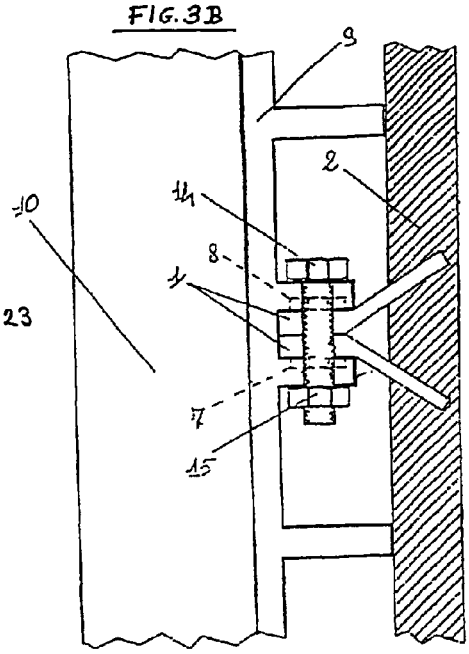
FIG. 3E
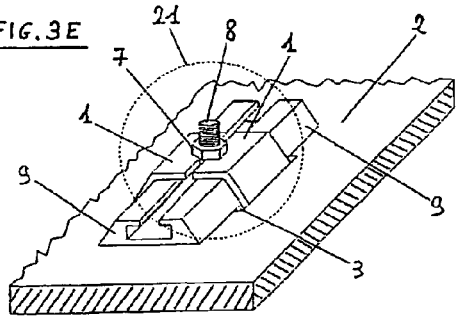
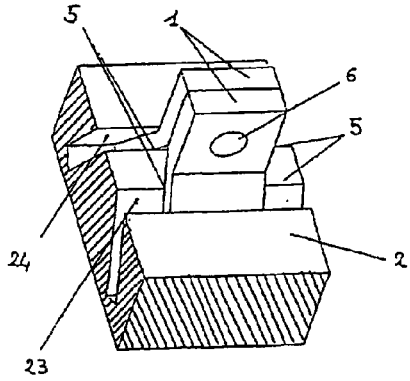
FIG. 3C
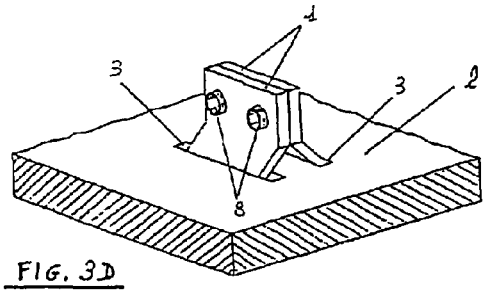
FIG. 3D

UNDERCUT ANCHORING ELEMENT FOR FIXING PLATES AND/OR TILES

The present invention relates to an undercut anchoring element for fixing plates and/or tiles, more particularly suitable for plates and/or tiles intended for front facing of buildings and the like.

The undercut anchoring elements for fixing plates and/or tiles are particularly adapted to carry out those facings using metal under-structures to which the tiles and/or plates are anchored with means that cannot be seen from the outside; these facings are commonly known as ventilated walls with concealed hooking because they allow air circulation in the gap created between facing and walls to be covered and do not allow to see from the outside the plate fixing and supporting elements.

The undercut anchoring elements for fixing plates and/tiles presently known, provide for adoption of screw anchors inserted in partially frustum conical dead holes made on the plate rear surface. These holes are made by sophisticated machinery, require highly skilled workers specific and equipped drilling centres that must arrange by means of suitable gauges, frequent and accurate checks of the holes, because the reduced undercut anchoring surface is not visible to the naked eye. Obviously the result is a high cost.

Another presently known anchoring element for fixing plates and/or tiles, provides for adoption of anchors with indented spring washers to be inserted in cylindrical dead holes. The washers have a greater diameter than the anchor body and when said anchor is pressed into the hole, the washers are bent and anchored in an undercut position constraining the washer to the plate. Also this system requires precise holes to be made with sophisticated machinery and highly skilled workers.

In both cases, as the plates and/or tiles used in the facings are mainly made of ceramic grès and/or materials with high hardness, in order to make the holes it is necessary to use special diamond tools known as drills, that are expensive and not very lasting. The undercut anchoring elements presently known moreover do not warrant any safety in case the plate and/or tile is detached from the anchor and falls down to the ground as a consequence of strong impacts, quakes and the like; on the rear side of the plate a net like body of glass wool is presently applied with suitable adhesives, preventing detachment of little pieces in case of plate breaking up. However this solution cannot avoid the detachment of the entire plate when just as a breaking up consequence, the undercut grip supplied by the anchors or washers is missing.

The object of the present invention is to provide an undercut anchoring element for fixing plated and/or tiles and the like allowing to remove said drawbacks and safe, cheap and simple to be manufactured.

These and other objects are attained by an undercut anchoring element for fixing plates and/or tiles, comprising two or more laminar bodies of metal or other material, so shaped that a portion is inserted in straight undercut dead notches symmetrically arranged radially or orthogonally to each other on the plate plane; the laminar bodies are of a sufficient lengths and such a shape as to project from the notch to be directly or even indirectly joined by an interposed body of metal and/or other material, with screws, bolts, hooks, joints, welding and the like, thus forming a single compact and strong block; the connection of the laminar bodies is such that each body is leaning on the edge with obtuse angle formed by intersection of the inner plane of the straight undercut notch with the plane of the notched plate and/or tile; by leaning on the corresponding edges of the notches, the laminar bodies oblige the portion inserted in the straight undercut notch to press strongly and hardly on the corresponding outer support plane, giving to the anchoring element a strong and sturdy constraint allowing to fix the plate and/or tile to the facing supporting structure safely and simply.

The advantages obtained with the present invention generally consist in that the straight undercut notches of the facing plates and/or tiles are made in a functional, quick and simple way without requiring special measures, and the laminar bodies, their joining and laying systems being simple and elementary.

Another advantage consists in that the straight undercut notches of the facing plates and/or tiles can be made of variable lengths and receive laminar bodies of different size, so as to allow to make anchoring adapted to withstand both moderate and high loads, rationally distributed on the surface of the plates to be fixed.

A further advantage consists in that the straight undercut notches of the facing plates and/or tiles can be made of variable depths, so as to allow to make undercut anchoring elements suitable for tiles and/or plates of different thickness.

Another advantage consists in that the laminar bodies to be inserted in the straight undercut notches of the facing plates and/or tiles can be made of different materials with different mechanical characteristics of elasticity, hardness and strength, with different thickness and/or shapes so as to meet any design requirement, that may provide for types of anchoring more or less elastic or rigid according to the kind of material, size and thickness of the facing to be used.

Still another advantage consists in that the straight undercut notches of the facing plates and/or tiles can allow that several juxtaposed laminar bodies may be inserted in each notch; in this way it is possible to position precisely the laminar bodies where fixing of the plate is required, so as to make laying easier and allow the workers to handle the fixing operations simply and rationally.

Another advantage consists in that the straight undercut notches of the facing plates and/or tiles can be simply made by using inexpensive and durable circular discs that are commonly available on the market.

Still another advantage consists in that the undercut anchoring element for fixing plates and/or tiles can comprise a block of three or more laminar bodies distributed on the plate so that each body can be inserted in one of the three or more straight undercut notches made radially or orthogonally on the plate plane. In this case the anchoring force of at least three laminar bodies is transferred to a single central body of metal and/or other material, joining the plates to each other; the facing support structure may be fixed to said body.

A further advantage consists in that the undercut anchoring element according to the invention is easy to be made and applied with consequent high inexpensiveness from the point of view of both materials and labour.

Still another advantage consists in that the undercut anchoring element according to the invention allows to interpose between the plate and the known net like bodies of glass wool applied with an adhesive on the rear side of the plate to avoid its breaking up, a cable of stainless steel or other flexible highly resistant material, which in case of breaking up the plate and/or tile, prevents it from detaching and falling down to the ground with serious risks of injuring persons and/or damaging objects.

In order to make clearer understanding of the present invention, a detailed description of the invention will now be given hereinafter as an illustrative and non limiting example only, with reference to the accompanying drawings in which:

FIGS. 3A to 3E are schematic perspective and/or sectional views of embodiments of undercut anchoring elements for fixing plates and/or tiles according to the invention, with laminar bodies inserted into straight undercut notches symmetrically made on the plate plane.

Figure 1:
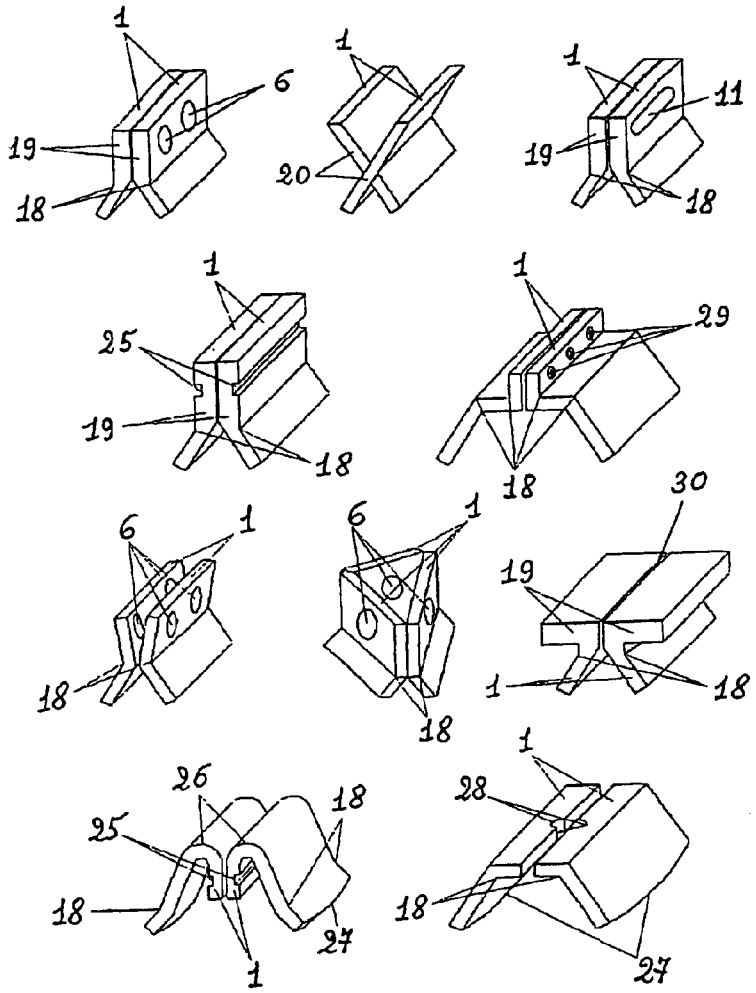
FIG. 1 is a schematic view of some embodiments of anchoring laminar bodies according to the invention.

The figures of the drawings refer to an undercut anchoring element for fixing plates and/or tiles 2 which generally consists of laminar bodies 1 made of stainless steel, music wire steel or any highly resistant material. The shape of the laminar bodies 1 is variable: said bodies may be straight 20, bent 18, with a thickened portion 19, provided with holes 6 or slots 11 and of different size. Several embodiments of the anchoring elements are shown in FIG. 1. Therefore the elements may also have notches 25 for a spring clamping like a clip, an upper band 26 giving elasticity to the blades, a lower rounded profile 27 for an optimal lodgement in the notch made by the grinding disk 4, a hole 28 to receive a tightening screw, a clamping obtained by spot welding 29 or a tightening support by a standard welding 30.

According to the number of laminar bodies, their shape, the arrangement on the plate and/or tile 2 and their thickness, specific preliminary works are needed, to be carried out on the plates and/or tiles 2, depending upon the material of said plates, their size, weight, thickness and the wind load to which they undergo when laid.

Figure 2A:
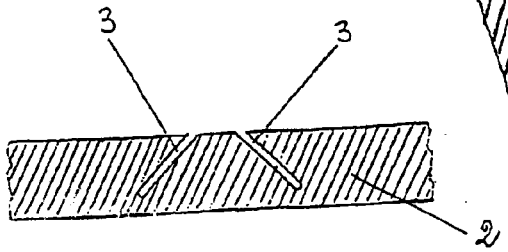
FIGS. 2A and 2B are schematic sectional and/or perspective views of preliminary works to be carried out on the facing plates and/or tiles to provide straight undercut notches into which the laminar bodies are inserted.
Figure 2B:
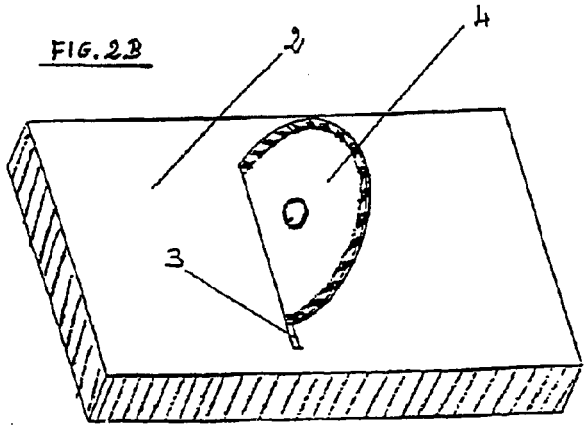
Figure 4:
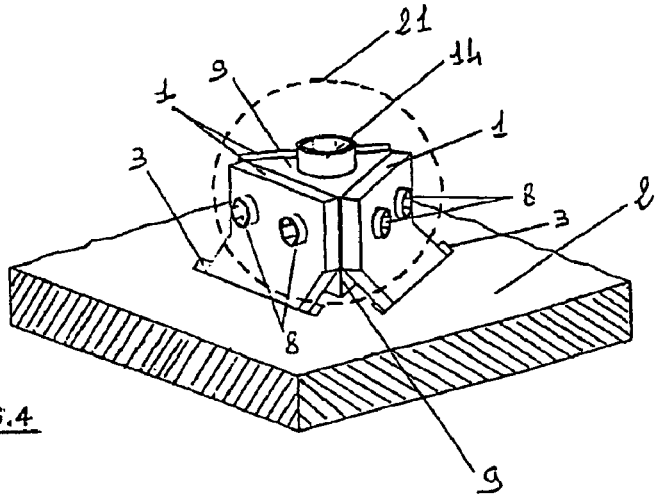
FIG. 4 is a schematic view of the undercut anchoring element for fixing plates and/or tiles according to the invention, with laminar bodies inserted into straight undercut notches made radially on the plate plane.
Figure 5:
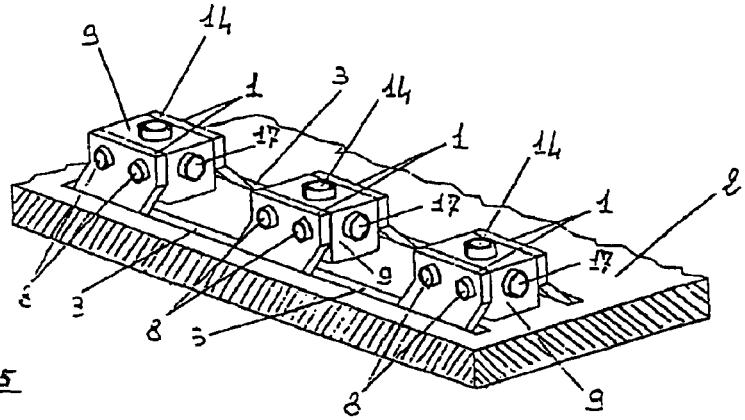
FIG. 5 is a schematic view of undercut anchoring elements for fixing plates and/or tiles according to the invention, with more laminar bodies inserted into the same straight undercut notch.
Figure 6:
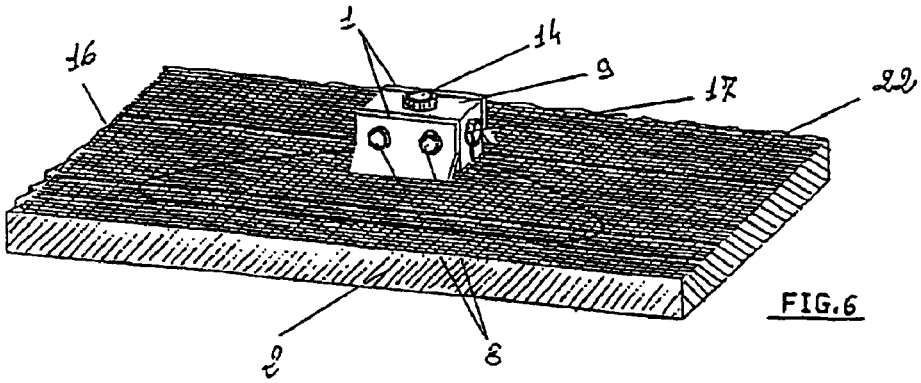
FIG. 6 is a schematic view of the undercut anchoring element of the invention, with laminar bodies inserted into straight undercut notches made symmetrically on the plate plane on which the anti-shattering net and the fall-safe cable were applied.
Figure 7:
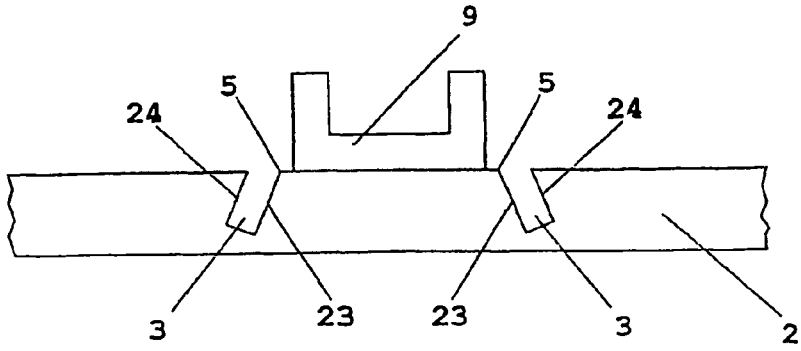
FIG. 7 is a sequential schematic view a), b), c) of the steps to firmly join a couple of laminar bodies inserted into straight undercut notches made on the plate and/or tile; the laminar bodies are joined by an interposed U profiled body.
Figure 7:
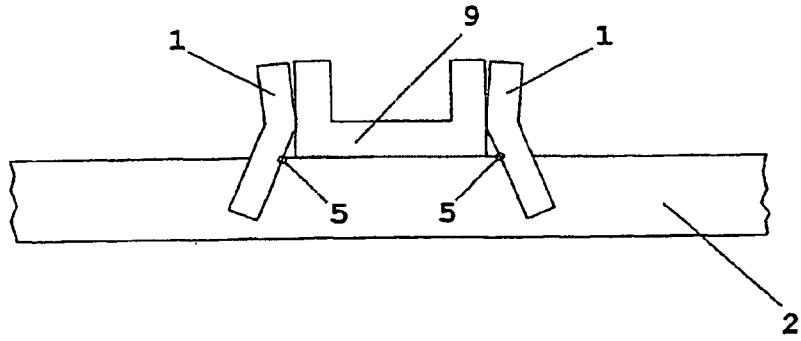
Figure 7:
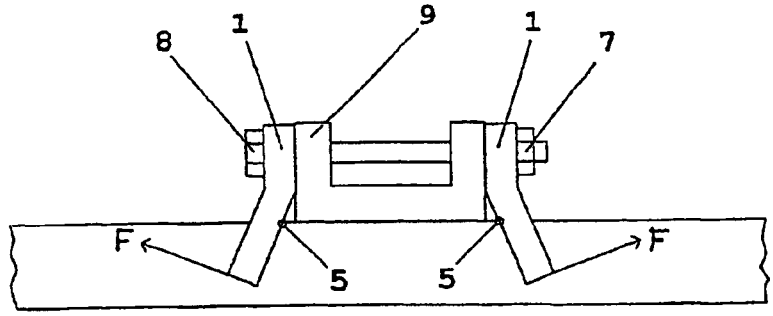

The preliminary works to be carried out on the plates and/or tiles 2, to be seen schematically in the views of FIGS. 2A and 2B, consist of two or more straight undercut notches 3 made by a simple disk grinding 4 of the plate and/or tile 2; the straight undercut notches 3 can be made of variable length and each notch may receive a portion of one or more juxtaposed laminar bodies 1 precisely arranged at the anchoring point.

The laminar bodies 1 are so shaped that a portion is inserted into straight undercut dead notches 3 made on the plane of the plate and/or tile 2; a portion of said bodies protrudes from the straight undercut notches 3 and takes such a position that allows by means of bolts 8 and nuts 7 to join them and obtain the undercut anchoring element 21 for fixing plates and/or tiles; the joint of the laminar bodies 1 is such that each body leans on the obtuse angle edge 5 formed by intersection of the inner plane 23 of the straight undercut notch 3 with the plane of the notched plate and/or tile 2; leaning on the corresponding edges of the notches 5, the laminar bodies 1 oblige the portion inserted into the straight undercut notch to press with a force F on the corresponding outer support plane 24, giving to the anchoring element 21 a strong and sturdy constraint allowing to fix the plate and/or tile 2 to the support structure of the facing 10 in a simple and safe way.

The fulcrum at which the lever constituted by the blades is leaning is not necessarily arranged on the edge of the notch made on the plate and/or tile, but may also act in proximity of said edge. This modification is particularly required in case where a proper bend of the blade allows to use the same lever principle of the present invention, although it does not act exactly on the notch edge.

The laminar bodies 1 protruding from the straight undercut notches 3 may take symmetrical mirror divergent, crossing or even spaced positions; in case of at least three laminar bodies, they may be arranged even radially. In any case the laminar bodies 1 are securely joined either directly to each other by means of bolts 8 inserted in holes 6 of the laminar bodies 1 and blocked by nuts 7; or by means of a suitable body 9 of metal and/or other material to which the laminar bodies 1 are securely fixed through the bolts 8. Joint of the laminar bodies 1 causes each body to lean on the edge 5 with obtuse angle, formed by intersection of the inner plane 23 of the straight undercut notch 3 with the plane of the notched plate and/or tile 2; leaning on the corresponding edges of notches 5, the laminar bodies 1 oblige the portion inserted into the straight undercut notch to press with the force F on the corresponding outer support plane 24 so as to give to the undercut anchoring element 21 for fixing plates and/or tiles a sturdy and strong constraint allowing to fix the plate and/or tile 2 by means on bolts 14 and nuts 15 to the metal support structure 10 in a simple and safe way.

FIG. 3A shows a metal profile with trapezoidal section 9 inside which a screw with nut 7 is lodged, that once tightened on the blades 1 arranged along the two inclined surfaces, provides for their secure joint. The principle of the anchoring system is still the same.

In applications on plates and/or tiles 2 provided with rear net like webs 22, previously applied with an adhesive on the rear side of the plate to avoid its breaking up, a cable 16 of flexible steel can be inserted with its ends fixed to the body 9 by bolts 17 and interposed between the plate and/or tile 2 and the net like body 22; in case of breaking up and detachment of the plate and/or tile 2, the flexible cable 16 provides for holding the broken up plate preventing its falling down to the ground.

While the present invention was described and illustrated according to embodiments given as non limiting examples only, it will be apparent to persons skilled in the art that various modifications to shape, details, orientations may be made without however falling outside its objects and scope.

What is claimed:

1. An anchoring system for fixing plates and/or tiles to a support structure, comprising plates or tiles (2), a support structure (10) and at least two anchoring elements comprising laminar bodies (1), a portion of said bodies being inserted into straight undercut dead notches (3) made in said plates and/or tiles (2), whereby the laminar bodies (1) are so shaped that when inserted in the notches (3), they lean on the corresponding edge (5) of the notch (3) or in proximity thereof with an obtuse angle, formed by the intersection of the inner plane (23) of the notch (3) with the plane of the plate and/or tile (2), characterized in that the portions of the laminar bodies (1) protruding from the straight undercut notches (3) being joinable so as to act as a support lever fulcrum causing the corresponding portions of the laminar body (1) inserted into the notches (3) to press strongly on the corresponding outer support plane (24) consequently giving to the anchoring element a strong and sturdy constraint allowing to fix the plate and/or tile to the facing support structure (10), and each straight undercut notch (3) has a variable length and may receive one or more juxtaposed laminar bodies (1) precisely arranged at the anchoring point.

2. An anchoring system for fixing plates and/or tiles to a support structure, comprising plates or tiles (2), a support structure (10) and at least two anchoring elements comprising laminar bodies (1), a portion of said bodies being inserted into straight undercut dead notches (3) made in said plates and/or tiles (2), whereby the laminar bodies (1) are so shaped that when inserted in the notches (3), they lean on the corresponding edge (5) of the notch (3) or in proximity thereof with an obtuse angle, formed by the intersection of the inner plane (23) of the notch (3) with the plane of the plate and/or tile(2), characterized in that the portions of the laminar bodies (1) protruding from the straight undercut notches (3) being joinable so as to act as a support lever fulcrum causing the corresponding portions of the laminar body (1) inserted into the notches (3) to press strongly on the corresponding outer support plane (24) consequently giving to the anchoring element a strong and sturdy constraint allowing to fix the plate and/or tile to the facing support structure (10), and said plates and/or tiles (2) are provided with rear net like webs (22) previously applied with an adhesive on the rear side of the plate to avoid its breaking up.

3. The anchoring system according to claim 2 characterized in that between plate and/or tile (2) and the net like body (22) a cable of stainless steel (16) or other flexible material may be inserted, the ends of said cable being fixed to the laminar bodies (1) or joining body (9), said cable in case of breaking up of the plate and/or tile (2) holding the broken up plate preventing it falling down to the ground.

4. A method of anchoring plates and/or tiles to a facing support structure: utilizing at least two anchoring elements having laminar bodies (1), a portion of said bodies being inserted into straight undercut dead notches (3) made in said plates and/or tiles (2), whereby the laminar bodies (1) are so shaped that when inserted in the notches (3), they lean on the corresponding edge (5) of the notch (3) or in proximity thereof with an obtuse angle, formed by the intersection of the inner plane (23) of the notch (3) with the plane of the plate and/or tile (2), wherein the portions of the laminar bodies (1) protruding from the straight undercut notches (3) being joinable so as to act as a support lever fulcrum causing the corresponding portions of the laminar body (1) inserted into the notches (3) to press strongly on the corresponding outer support plane (24) consequently giving the anchoring element a strong and sturdy constraint to fix the plate and/or tile to the facing support structure (10), comprising the steps of: making straight undercut dead notches (3) in the rear surface of said plates and/or tiles (2); providing at least two anchoring elements comprising laminar bodies (1); inserting a portion of said laminar bodies (1) into said notches (3); joining the portions of laminar bodies (1) protruding from the undercut notches (3) so as to act as a support level fulcrum; fixing the anchoring elements to the support structure; and wherein the plates and/or tiles are provided with rear net-like webs (22) previously applied with an adhesive on the rear side of the plate to avoid its breakup.

5. The method of claim 4 wherein between plate and/or tile (2) and the net-like body (22) a cable of stainless steel (16) or other flexible material may be inserted, the ends of said cable being fixed to the laminar bodies (1) or joining body (9), said cable in case of breaking up of the plate and/or tile (2) holding the broken up plate preventing it falling down to the ground.

6. An anchoring system for fixing plates and/or tiles to a support structure, plates and/or tiles (2) having a pair of straight undercut notches (30) formed at an angle to each other each defined by an inner support plane (23) having an obtuse angle edge (5) and an outer support plane (24) formed therein, at least two anchoring elements (21) each anchoring element comprising a pair of laminar bodies (1) adapted to be partially inserted into one of said undercut notches formed on said plates and/or tiles, wherein a portion of said laminar bodies (1) protrudes from said undercut notches, wherein said protruding portions of said laminar body pair are rigidly connected such that said anchoring element acts as a support fulcrum causing the portions of said laminar bodies (1) inserted into said undercut notches (30) to simultaneously engage said obtuse angle edge (5) of said inner support plane and said outer support plane (24).

7. The anchoring system of claim 6 wherein said pair of straight undercut notches (30) are symmetrical and mirror divergent.

8. An anchoring system for fixing plates and/or tiles to a support structure, comprising plates or tiles (2), a support structure (10) and at least two anchoring elements comprising laminar bodies (1), a portion of said bodies being inserted into straight undercut dead notches (3) made in said plates and/or tiles (2), whereby the laminar bodies (1) are so shaped that when inserted in the notches (3), they lean on the corresponding edge (5) of the notch (3) or in proximity thereof with an obtuse angle, formed by the intersection of the inner plane (23) of the notch (3) with the plane of the plate and/or tile (2), characterized in that the portions of the laminar bodies (1) protruding from the straight undercut notches (3) being joinable through bolts (8) and nuts (7) or by joints or welding, said welding being carried out by spot welding and the like so as to act as a support lever fulcrum causing the corresponding portions of the laminar body (1) inserted into the notches (3) to press strongly on the corresponding outer support plane (24) consequently giving to the anchoring element a strong and sturdy constraint allowing to fix the plate and/or tile to the facing support structure (10).

9. An anchoring system for fixing plates and/or tiles to a support structure, comprising plates or tiles (2), a support structure (10) and at least two anchoring elements comprising laminar bodies (1), a portion of said bodies being inserted into straight undercut dead notches (3) made in said plates and/or tiles (2), whereby the laminar bodies (1) are so shaped that when inserted in the notches (3), they lean on the corresponding edge (5) of the notch (3) or in proximity thereof with an obtuse angle, formed by the intersection of the inner plane (23) of the notch (3) with the plane of the plate and/or tile (2), characterized in that the portions of the laminar bodies (1) protruding from the straight undercut notches (3) being joinable so as to act as a support lever fulcrum causing the corresponding portions of the laminar body (1) inserted into the notches (3) to press strongly on the corresponding outer support plane (24) consequently giving to the anchoring element a strong and sturdy constraint allowing to fix the plate and/or tile to the facing support structure (10) and said laminar bodies (1) protruding portions are so shaped that between the laminar bodies (1) a body (9) of metal and/or other material is interposed, to which said laminar bodies (1) are securely fixed through bolts (8) or other means such as joints or welding.

* * * * *